US005279499A

United States Patent [19]

Carter

[11] Patent Number: 5,279,499

[45] Date of Patent: Jan. 18, 1994

[54] BRUSH ASSEMBLY WITH CARTRIDGE HAVING FLOW CONTROL

[76] Inventor: Frederick E. Carter, 196 Browning St., Pomona, Calif. 91767

[21] Appl. No.: 986,510

[22] Filed: Dec. 7, 1992

[51] Int. Cl.[5] ..... A46B 11/04

[52] U.S. Cl. ..... 401/274; 401/276; 401/277; 401/205; 401/219

[58] Field of Search ..... 401/133-135, 401/276, 277, 274, 280, 205, 219

[56] References Cited

U.S. PATENT DOCUMENTS

| | | | |
|---|---|---|---|
| 752,078 | 2/1904 | La Burt et al. | 401/276 |
| 1,428,079 | 9/1922 | Clark | 401/135 |
| 1,935,639 | 11/1933 | Keeshan | 401/276 X |
| 2,045,774 | 6/1936 | Hirschy | 401/133 |
| 2,557,267 | 6/1951 | Ellinger | 401/276 |
| 3,065,732 | 11/1962 | Fejes | 401/219 X |

*Primary Examiner*—Danton D. DeMille

[57] ABSTRACT

A brush assembly for use by artists and others, which includes an elongated barrel with a brush at one end, and which includes an internal removable cartridge. The assembly is constructed to assure the controlled flow of writing fluid from the interior of the cartridge to the brush without excess fluid being fed to the brush, and to assure that there will be no flow of fluid to the brush when the brush assembly is not in use.

6 Claims, 1 Drawing Sheet

42
44
40
34
10
24
22
20
52

42
44
40
34
32
36
28
50
30
12
10
14
26
22
18
16
24
22
20
52

BRUSH ASSEMBLY WITH CARTRIDGE HAVING FLOW CONTROL

BACKGROUND OF THE INVENTION

Various types of brush assemblies have been designed in the past in which ink or other writing fluid, is contained in the barrel of the assembly to provide a continuous supply of ink to the brush which is mounted at one end of the barrel. This eliminates the necessity of repeatedly dipping the brush into an ink bottle, or the like, as it is being used.

However, problems have arisen in the past in accurately controlling the flow of the fluid to the brush, in preventing clogging; and also for cutting off the flow of fluid when the brush is not in use to assure that there is no leakage of the fluid, all without making the assembly unduly bulky or expensive.

An objective of the present invention is to provide an improved brush assembly which is simple in its construction, compact in size, and easy to use. The brush assembly of the invention is particularly constructed to overcome the problems encountered with the prior art brushes, as mentioned above.

DETAILED DESCRIPTION OF THE ILLUSTRATED EMBODIMENT

Figure 1:
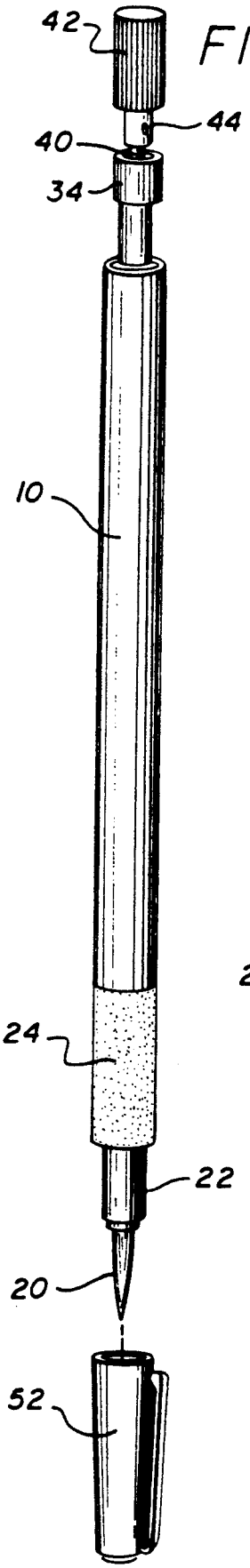
FIG. 1 is a side view of the brush assembly of the invention in one of its embodiments.
Figure 2:
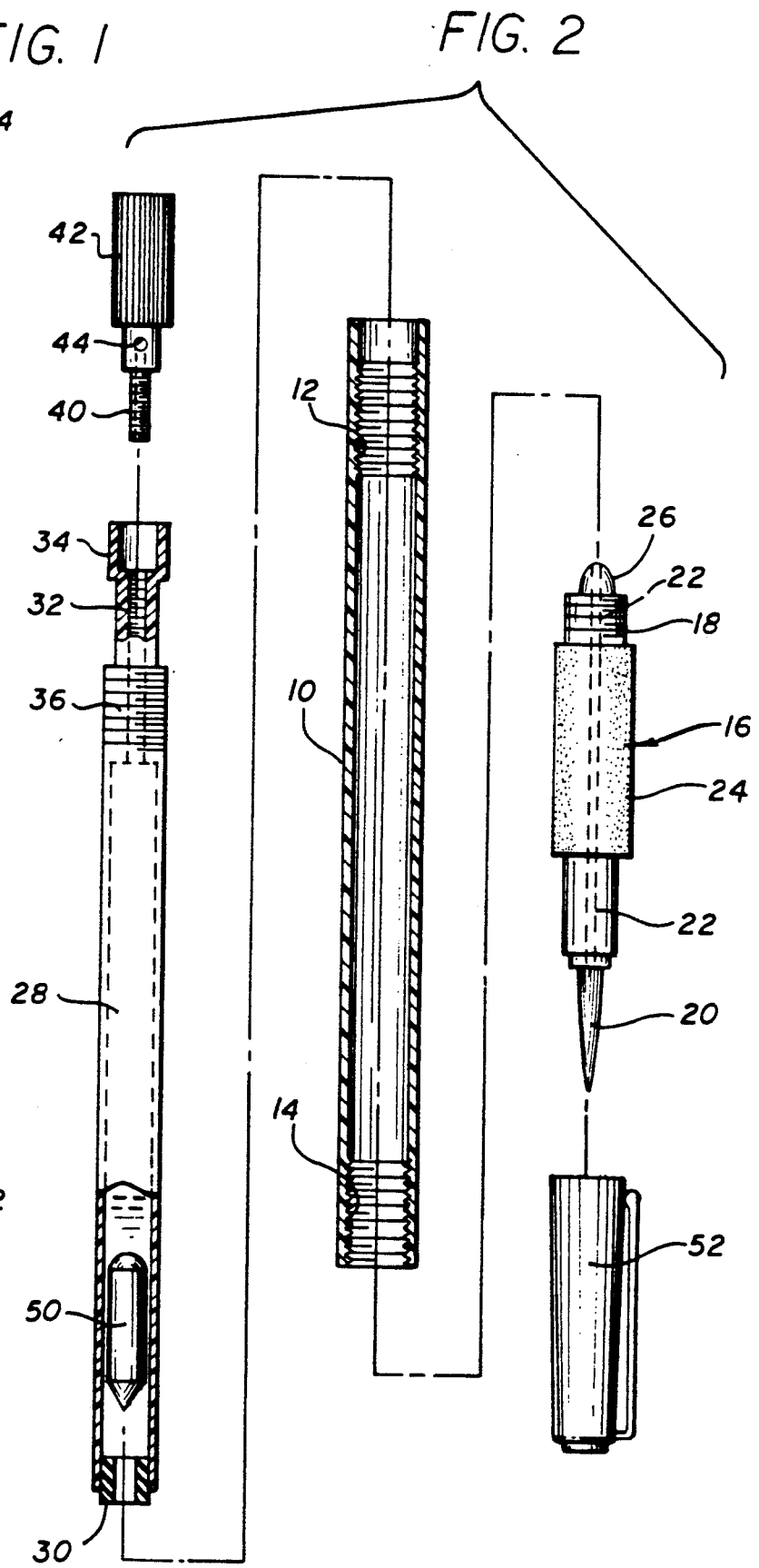
FIG. 2 is a detached view showing the various components which make up the improved brush assembly of the present invention.

The brush assembly of the present invention, as shown in FIGS. 1 and 2 includes an elongated hull barrel 10, having a internal threads 12 at one end, and internal threads 14 at the other. A tubular bracket 16 is attached to the lower end of barrel 10 and in axial relationship therewith by threads 18 which are threaded into the internal threads 14 of the barrel. A brush 20 is supported at the lower end of bracket 16. A cap 52 fits over brush 20 when the unit is not in use. A tubular member 22 extends through the bracket 16 in coaxial relationship from one end of the bracket to other. A rubber sleeve 24 is mounted on bracket 16 which serves as a grip and a back-up seal. The tubular member 22 protrudes through the top of bracket 16, and a plastic tube 26 is mounted on the protruding end of the tubular member.

A removable cartridge 28 is inserted through the upper end of barrel 10, and the cartridge extends coaxially through the barrel from one end to the other. A rubber bushing 30 is mounted at the lower end of the cartridge 28 in position to receive the plastic tube 26 of tubular member 22. Plastic tube 26 is hard enough to penetrate the opening in bushing 30. Accordingly, the tubular member 22 provides a path for the ink from the cartridge 28 to the brush 20.

The upper end of the cartridge includes a hollow screw 32 which is integral with cartridge 28, and a plastic sleeve 34 is mounted at the upper end of screw 32. Screw 32 has internal threads. The upper end of the cartridge 28 has threads 36, and when the cartridge is inserted into the barrel 10, the sleeve 34 enables the threads 36 of the cartridge to be threaded into the internal threads 12 at the upper end of the barrel.

A hollow screw 40 is threaded down into the hollow screw 32. A rubber sleeve tip 42 is mounted over the upper end of screw 40, and it seals the upper end of screw 40, and the sleeve 42 also provides a means for grasping the screw to thread it down into the screw 32, and to screw the cartridge 28 tightly to the upper end of the barrel. A radial air hole 44 is provided in the hollow screw 40, so that when the screw 40 is partially unscrewed from the screw 32, the air hole is exposed, and forces ink from the cartridge through the tubular member 22 to the brush 20.

However, when the screw 40 is screwed completely into the hollow screw chamber 32, the ink is retained in the cartridge and does not flow through the bushing 30 at its lower end. A freely movable plunger 50 is provided within the cartridge to prevent clogging of the ink flowing through bushing 30, and to control the flow of ink to the brush.

Accordingly, to use the brush of the invention, the bracket 16 is first threaded to the lower end of the barrel. Cartridge 28 is then inserted down into the barrel 10 through the upper end of the barrel, and the cartridge is screwed into place by turning sleeve 42. The hollow screw 40 is then partially unthreaded from the screw 32 by turning the sleeve 42 in the opposite direction, and the resulting air flowing into the cartridge through the air hole 44, causes the ink to flow from the cartridge through the tubular member 22 to the brush 20. A slight shake of the unit will move member 50 away from busing 30 to permit a monitored amount of ink to flow to the brush 20.

The invention provides, therefor, a simple and inexpensive fountain brush which includes a removable cartridge, and which is constructed so that free flow of the writing fluid from the cartridge when required is assured, and which also is constructed so that there is no tendency for the writing fluid to flow when the brush is not in use so that drippings from the brush is prevented. Also, the improved assembly of the invention is constructed so that any tendency for leakage of the fluid from the cartridge is prevented.

While a particular embodiment of the invention has been shown and described, modifications may be made. It is intended in the claims to cover all modifications which come within the true spirit and scope of the invention.

I claim:

1. A brush assembly comprising: an elongated hollow barrel; a tubular bracket mounted on the lower end of said barrel in coaxial relationship therewith; a brush mounted on the lower end of said bracket; an elongated fluid-carrying cartridge removably mounted in said barrel and extending longitudinally within said barrel from one end to the other; a first tubular member extending longitudinally through said tubular bracket between the lower end of said cartridge and said brush to provide a path for fluid from said cartridge to said brush; a second hollow tubular member mounted on the upper end of said cartridge in coaxial relationship therewith; a third tubular member extending into said second tubular member in coaxial relationship therewith for rectilinear movement with respect thereto, the upper end of said third tubular member protruding upwardly from said second tubular member and said upper end of said third tubular member having a radial air hole therein to be exposed when said third tubular member is partially withdrawn from said second tubular member; a sleeve mounted on the protruding end of said third tubular member and to providing means for grasping and sealing for said third tubular member; and a plunger contained in said cartridge and freely moveable therein in a longitudinal direction for regulating the flow of writing fluid through the lower end of said cartridge to said brush.

2. The brush assembly defined in claim 1, in which the upper end of said cartridge has external threads which engage internal threads formed in the upper end of said barrel.

3. The brush assembly defined in claim 1, and which includes a rubber-like sleeve mounted on said tubular bracket to serve as a grip and back-up seal.

4. The brush assembly defined in claim 1, in which the upper end of said tubular bracket has external threads which engage internal threads formed in the lower end of said barrel.

5. The brush assembly defined in claim 1, in which the lower end of said cartridge has a resilient bushing formed therein, and the upper end of said first tubular member is configured to be received in said bushing in a sealing fit therewith.

6. The brush assembly defined in claim 1, in which said second tubular member has internal threads, and said third tubular member has external threads for threaded engagement with the internal threads of said second tubular member.

* * * * *